US010320155B2

(12) United States Patent
Idogawa

(10) Patent No.: US 10,320,155 B2
(45) Date of Patent: Jun. 11, 2019

(54) IGNITION DEVICE FOR INTERNAL COMBUSTION ENGINE

(71) Applicant: Mitsubishi Electric Corporation, Tokyo (JP)

(72) Inventor: Takashi Idogawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/765,922

(22) PCT Filed: Nov. 12, 2015

(86) PCT No.: PCT/JP2015/081846
§ 371 (c)(1),
(2) Date: Apr. 4, 2018

(87) PCT Pub. No.: WO2017/081788
PCT Pub. Date: May 18, 2017

(65) Prior Publication Data

US 2018/0309268 A1 Oct. 25, 2018

(51) Int. Cl.

| | |
|---|---|
| ***H01T 13/04*** | (2006.01) |
| ***F02P 3/04*** | (2006.01) |
| ***F02P 13/00*** | (2006.01) |
| ***H01F 38/12*** | (2006.01) |

(52) U.S. Cl.
CPC ..... *H01T 13/04* (2013.01); *F02P 3/04* (2013.01); *F02P 13/00* (2013.01); *H01F 38/12* (2013.01)

(58) Field of Classification Search
CPC ..... H01T 13/04
See application file for complete search history.

(56) References Cited

FOREIGN PATENT DOCUMENTS

| | | | |
|---|---|---|---|
| JP | 6-26434 | A | 2/1994 |
| JP | 3556725 | B2 | 8/2004 |
| JP | 2008-274814 | A | 11/2008 |
| JP | 2013-62471 | A | 4/2013 |

OTHER PUBLICATIONS

International Search Report for PCT/JP2015/081846 dated Feb. 2, 2016 [PCT/ISA/210].

*Primary Examiner* — Joseph L Williams
(74) *Attorney, Agent, or Firm* — Sughrue Mion, PLLC; Richard C. Turner

(57) ABSTRACT

This invention is concerning an ignition device for an internal combustion engine, wherein a plug boot has a reduced-inner-diameter portion having an inner diameter size smaller than that of the other portion, a spring has a larger diameter portion having a diameter size larger than that of the other portion, and a plurality of reduced clearances each having a width reduced by the reduced-inner-diameter portion and the larger diameter portion are formed between the spring and the inner wall surface of the plug boot.

4 Claims, 3 Drawing Sheets

IGNITION DEVICE FOR INTERNAL COMBUSTION ENGINE

CROSS REFERENCE TO RELATED APPLICATIONS

This application is a National Stage of International Application No. PCT/JP2015/081846 filed Nov. 12, 2015.

TECHNICAL FIELD

This invention relates to an ignition device for an internal combustion engine which is mostly attached to a vehicular internal combustion engine, e.g., the internal combustion engine of an automobile to supply a high voltage to an ignition plug and cause a spark discharge.

BACKGROUND ART

To meet the recent need to improve fuel efficiency, a method which improves fuel efficiency by attaching various devices to an internal combustion engine has been used. For example, an actuator for suspending cylinders which suspends some of cylinders depending on a VVT (Variable Valve Timing) for controlling the timings of intake/exhaust valves or a running condition has been known.

This may result in a complicated layout over cylinder heads so that a plug hole is extended and the foregoing devices are laid out in the resulting space. In this case, the distance between an ignition plug and the insulating case of an ignition coil increases and consequently the length of a plug boot is increased.

This also places limitations on the space around the ignition plug, whereby the ignition plug tends to have a smaller diameter.

In a conventional ignition device for an internal combustion engine, the inner diameter shape of a plug boot is determined in accordance with the diameter of an ignition plug. In addition, in accordance with the distance between the ignition plug and an ignition coil and the inner diameter shape of the plug boot, the spring constant and resonance frequency of a spring as an interposing member in the axial direction of the ignition plug are set.

There have been proposed an ignition device in which a metal pipe is inserted into a plug boot to prevent lateral vibration of a spring during the vibration of an internal combustion engine (see PTL 1) and an ignition coil in which the inner diameter of a plug boot is locally reduced to prevent the lateral vibration (PTL 2).

CITATION LIST

Patent Literature

[PTL 1] Japanese Patent No. 3556725

[PTL 2] Japanese Patent Application Publication No. H06-26434

SUMMARY OF INVENTION

Technical Problem

However, the former case has a problem in that another member is necessary and cost increases.

In the latter case, there are limitations on the shape of the ignition plug and the inner diameter of the plug boot and limitations on the inner diameter of the plug boot and the outer diameter of the spring. It is difficult to appropriately set the spring constant and resonance frequency of the spring even when the length of the plug boot is increased, while meeting these limitations in the ignition plug having the reduced diameter.

An object of this invention, which aims to solve such problems, is to obtain an ignition device for an internal combustion engine which prevents lateral vibration of a spring and improves the design flexibility of a spring, while suppressing cost increases for internal combustion engines having various layouts.

Solution to Problem

An ignition device for an internal combustion engine according to this invention includes an ignition coil having a primary coil, a secondary coil, an iron core magnetically coupling the primary coil and the secondary coil to each other, and an insulating case containing the primary coil, the secondary coil, and the iron core; a high-voltage tower provided integrally with the insulating case and internally holding a high-voltage output terminal which outputs, to the outside of the ignition coil, a high voltage generated in the secondary coil when conduction of an excitation current flowing in the primary coil is interrupted; a plug boot formed in a cylindrical shape and having an end portion attached to the high-voltage tower; and an interposing member provided in the plug boot and having a spring that is formed in a coil shape and electrically connects, to the high-voltage output terminal, an ignition plug terminal of an ignition plug having a tip portion facing an inside of a cylinder of the internal combustion engine, wherein the plug boot has a reduced-inner-diameter portion having an inner diameter size smaller than that of another portion, the spring has a larger diameter portion having a diameter size larger than that of another portion, and a plurality of reduced clearances each having a width reduced by the reduced-inner-diameter portion and the larger diameter portion are formed between the spring and an inner wall surface of the plug boot.

Advantageous Effects of Invention

In the ignition device for the internal combustion engine according to this invention, in the clearance between the spring and the inner wall surface of the plug boot, the plurality of reduced clearances are formed by the reduced-inner-diameter portion formed in the plug boot and the larger diameter portion formed in the spring. This can suppress a cost increase and prevent lateral vibration.

In addition, in the setting of the spring constant and resonance frequency of the spring, the larger diameter portion of the spring is added to setting elements in addition to a spring length, a material, and the like. This improves the design flexibility of the spring constant and the resonance frequency.

DESCRIPTION OF EMBODIMENTS

Figure 1:
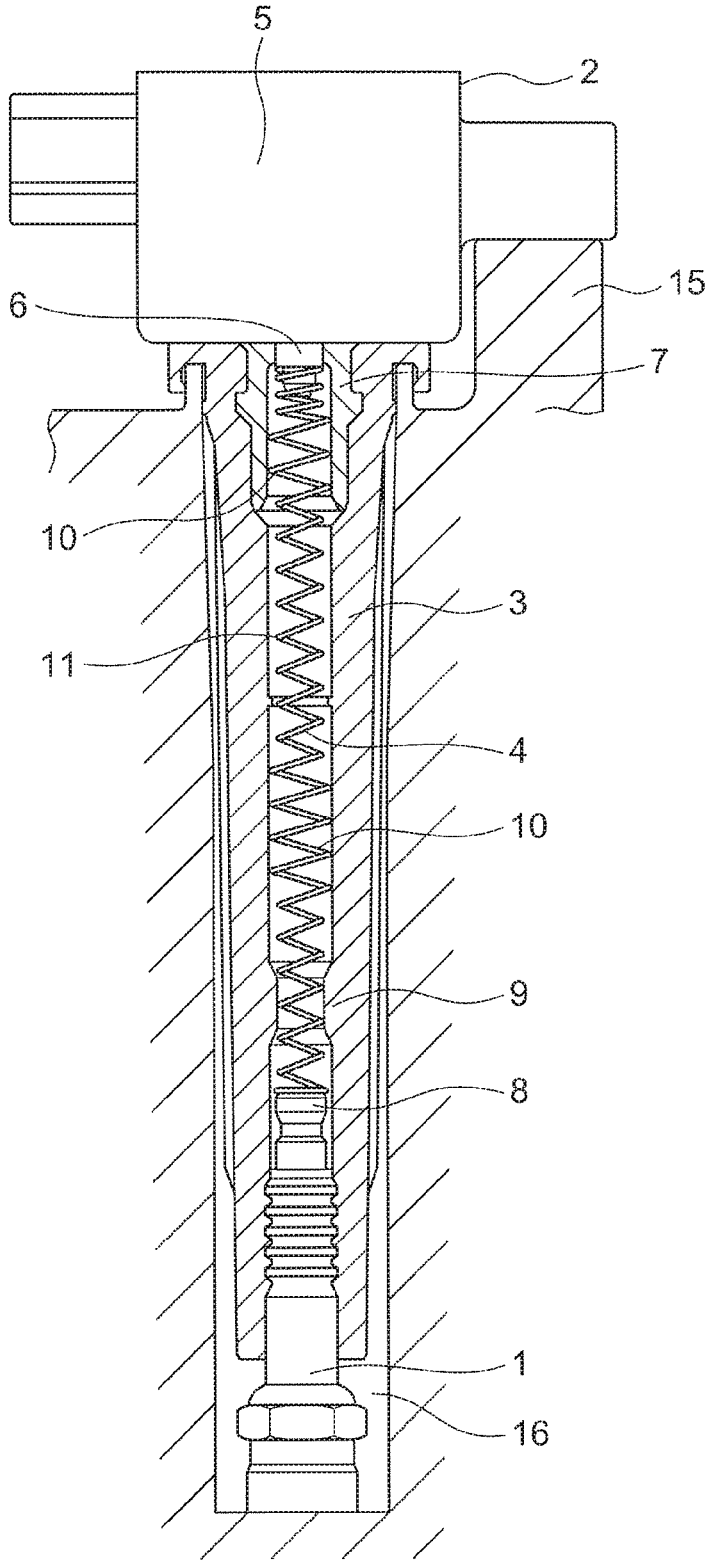
FIG. 1 is a partial cross-sectional view showing an ignition device for an internal combustion engine in Embodiment 1 of this invention.

The following will describe an ignition device for an internal combustion engine in each of the embodiments of this invention on the basis of the drawings. Note that, in each of the drawings, like or corresponding members and parts will be given like reference numerals when described.

Embodiment 1

FIG. 1 is a partial cross-sectional view showing an ignition device for an internal combustion engine in Embodiment 1 of this invention.

This ignition device includes an ignition coil 2 fixed to a cylinder head cover 15 with bolts (not shown), a plug boot 3 formed in a cylindrical shape and contained in a plug hole 16, while having an upper end portion fit into the cylinder head cover 15, and a coil-shaped spring 4 as an interposing member contained in the plug boot 3 and electrically connecting an ignition plug 1 having a tip portion facing the inside of a cylinder (not shown) of the internal combustion engine to the ignition coil 2.

The ignition coil 2 includes a primary coil (not shown), a secondary coil (not shown), and an iron core (not shown) magnetically coupling the primary coil and the second coil to each other, which are contained in an insulating case 5. With the bottom portion of the insulating case 5, a high-voltage tower 7 is integrally provided. The high-voltage tower 7 in which the end portion of the plug boot 3 is fitted has a high-voltage output terminal 6 therein. The high-voltage output terminal 6 outputs, to the outside, a high voltage generated in the secondary coil when conduction of an excitation current flowing in the primary coil is interrupted. The spring 4 has one end portion engaged with the high-voltage output terminal 6 so as to surround the high-voltage output terminal 6. The spring 4 has the other end portion engaged with an ignition plug terminal 8 of the ignition plug 1 so as to surround the ignition plug terminal 8.

The inner diameter portion of the plug boot 3 is not constant, and the plug boot 3 has a thicker portion 9 corresponding to a reduced-inner-diameter portion having an inner diameter smaller than that of the other portion and formed closer to the ignition plug 1. The thicker portion 9 protrudes inwardly in a radial direction around the entire circumference of the inner wall surface of the plug boot 3.

The diameter size of the coil-shaped spring 4 is also not constant, and the coil-shaped spring 4 has two larger diameter portions 10 each having a diameter larger than that of a smaller diameter portion 11. The size of each of the larger diameter portions 10 in the radial direction is larger than the inner diameter size of the thicker portion 9 of the plug boot 3.

In the ignition device for the internal combustion engine having the foregoing configuration, in the ignition coil 2, a primary current which flows in the primary coil in response to a signal from a control unit (not shown) is intermittently interrupted, and a high voltage is generated in the secondary coil in response thereto.

This high voltage is led from the high-voltage output terminal 6 to the ignition plug terminal 8 of the ignition plug 1 via the spring 4 and discharged in a plug gap (not shown) to ignite an air-fuel mixture in the cylinder of the internal combustion engine.

In the ignition device for an internal combustion engine having the foregoing configuration, the plug boot 3 has the thicker portion 9 corresponding to a reduced-inner-diameter portion having an inner diameter size smaller than that of the other portion, while the spring 4 has the larger diameter portions 10 each having a diameter size larger than that of the other portion. Between the spring 4 and the inner wall surface of the plug boot 3, a plurality of reduced clearances each having a width reduced by the thicker portion 9 and the larger diameter portions 10 are formed.

Accordingly, using the thicker portion 9 and the larger diameter portions 10, it is possible to suppress vibration of the spring 4 in the radial direction.

In addition, even when, e.g., the length of the plug boot 3 is increased, by determining the appropriate locations and number of the larger diameter portions 10 of the spring 4, it is possible to set the appropriate spring constant and resonance frequency of the spring 4.

Since the diameter of each of the larger diameter portions 10 is larger than the inner diameter of the thicker portion 9, during an operation of attaching the ignition device to the internal combustion engine, there is no detachment of the spring 4 from the plug boot 3, resulting in improved assembling operability.

Embodiment 2

Figure 2:
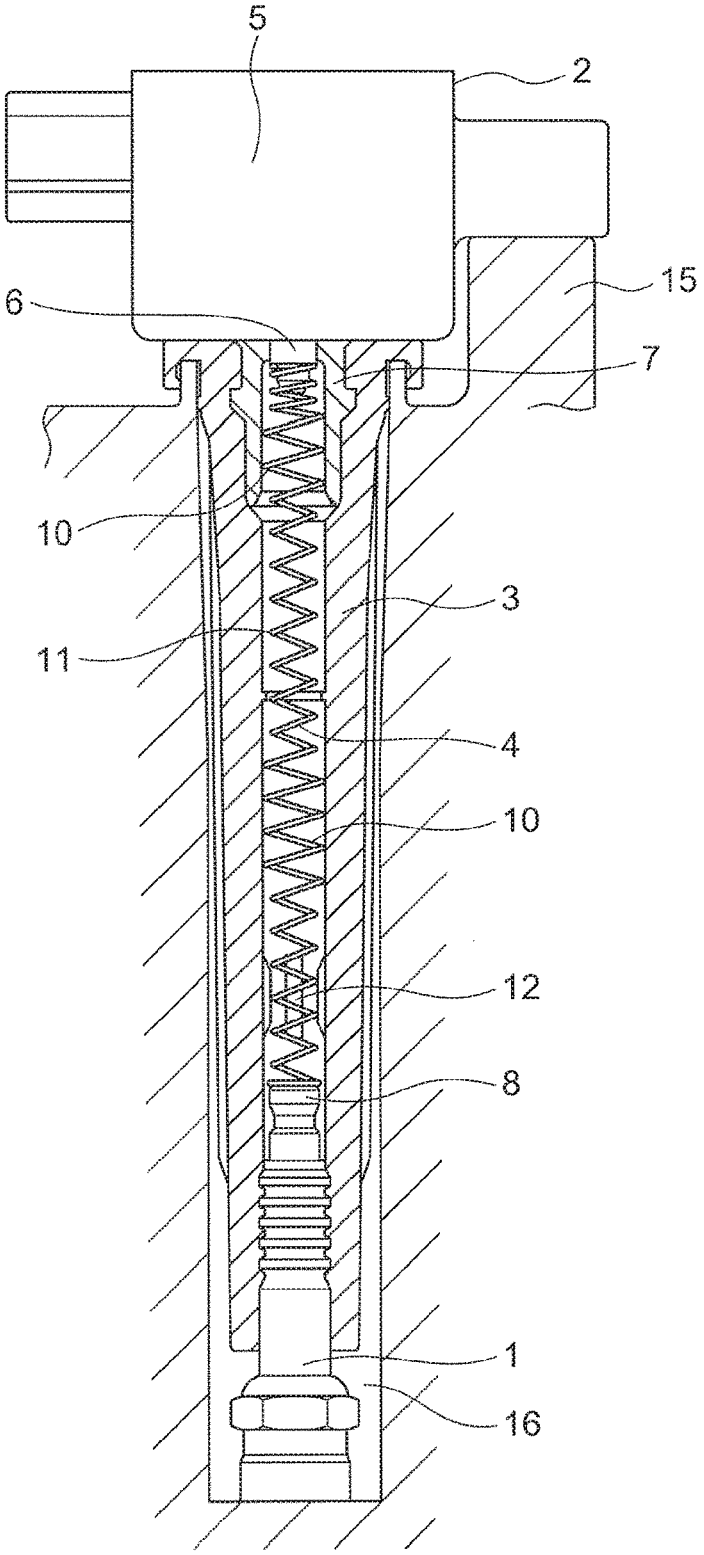
FIG. 2 is a partial cross-sectional view showing an ignition device for an internal combustion engine in Embodiment 2 of this invention.

FIG. 2 is a partial cross-sectional view showing an ignition device for an internal combustion engine in Embodiment 2 of this invention.

In this ignition device, the inner wall surface of the plug boot 3 has a plurality of ribs 12 formed as the reduced-inner-diameter portion to protrude therefrom inwardly in the radial direction.

The configuration of the ignition device for an internal combustion engine is otherwise the same as that of the ignition device for an internal combustion engine in Embodiment 1.

The ignition device for an internal combustion engine in this embodiment allows the same effects as obtained from that in Embodiment 1 to be obtained. In addition, the total volume of the ribs 12 as the reduced-inner-diameter portion is smaller than that of the thicker portion 9. Accordingly, the material cost of the plug boot 3 is reduced compared to that of the plug boot 3 in Embodiment 1.

Embodiment 3

Figure 3:
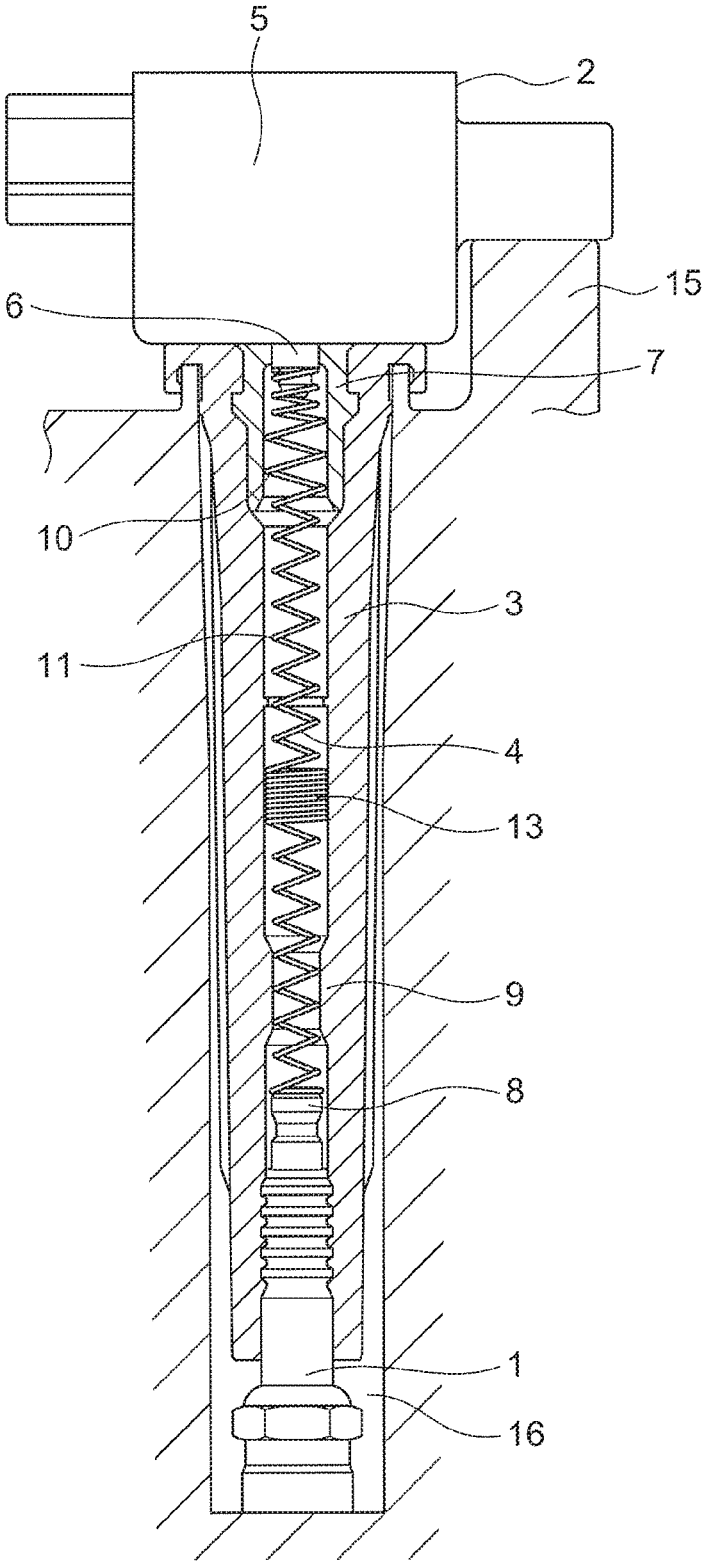
FIG. 3 is a partial cross-sectional view showing an ignition device for an internal combustion engine in Embodiment 3 of this invention.

FIG. 3 is a partial cross-sectional view showing an ignition device for an internal combustion engine in Embodiment 3 of this invention.

In the ignition device, the larger diameter portion of the spring 4 in the middle part thereof is formed of a closely wound coil 13 which is closely wound over a length of 3 mm or more.

The configuration of the ignition device for an internal combustion engine is otherwise the same as that of the ignition device for an internal combustion engine in Embodiment 1.

The ignition device for an internal combustion engine in this embodiment has a small clearance between the closely wound coil 13 and the inner wall surface of the plug boot 3, which can suppress the vibration of the spring 4 in the radial direction in association with the thicker portion 9 of the plug boot 3.

The closely wound coil 13 also has the function of a fixed point for the vibration of the spring 4 and increases the strength of the spring 4.

In each of the foregoing embodiments, one end portion of the spring 4 is engaged with the high-voltage output terminal 6 so as to surround the high-voltage output terminal 6, while the other end portion of the spring 4 is engaged with the ignition plug terminal 8 so as to surround the ignition plug terminal 8. However, it may also be possible to form respective recessed portions in the end surfaces of both of the high-voltage output terminal 6 and the ignition plug terminal 8 and fit the both end portions of the spring 4 into the recessed portions.

Also, each of the thicker portion 9, the ribs 12, the larger diameter portion 10, and the closely wound coil 13 may be formed at only one location or each of a plurality of locations.

Also, in each of the foregoing embodiments, the interposing member is formed only of the spring 4. However, the interposing member may also be respective springs disposed on both sides of a rod-shaped conductor.

Reference Signs List

| | |
|---|---|
| 1 | Ignition plug |
| 2 | Ignition coil |
| 3 | Plug boot |
| 4 | Spring (Interposing member) |
| 5 | Insulating case |
| 6 | High-voltage output terminal |
| 7 | High-voltage tower |
| 8 | Ignition plug terminal |
| 9 | Thicker portion (Reduced-inner-diameter portion) |
| 10 | Larger diameter portion |
| 11 | Smaller diameter portion |
| 12 | Rib |
| 13 | Closely wound coil |
| 15 | Cylinder head cover |
| 16 | Plug hole |

The invention claimed is:

1. An ignition device for an internal combustion engine, the ignition device comprising:

an ignition coil having a primary coil, a secondary coil, an iron core magnetically coupling the primary coil and the secondary coil to each other, and an insulating case containing the primary coil, the secondary coil, and the iron core;

a high-voltage tower provided integrally with the insulating case and internally holding a high-voltage output terminal which outputs, to the outside of the ignition coil, a high voltage generated in the secondary coil when conduction of an excitation current flowing in the primary coil is interrupted;

a plug boot formed in a cylindrical shape and having an end portion attached to the high-voltage tower; and an interposing member provided in the plug boot and having a spring that is formed in a coil shape and electrically connects, to the high-voltage output terminal, an ignition plug terminal of an ignition plug having a tip portion facing an inside of a cylinder of the internal combustion engine, wherein the plug boot has a reduced-inner-diameter portion having an inner diameter size smaller than that of another portion, the reduced-inner-diameter portion is formed of a plurality of ribs protruding inwardly in a radial direction from the inner wall surface, the spring has a larger diameter portion having a diameter size larger than that of another portion, and a plurality of reduced clearances each having a width reduced by the reduced-inner-diameter portion and the larger diameter portion are formed between the spring and an inner wall surface of the plug boot.

2. The ignition device for an internal combustion engine of claim 1, wherein at least one of a plurality of the larger diameter portions is formed of a closely wound coil.

3. The ignition device for an internal combustion engine of claim 2, wherein a diameter of the larger diameter portion is larger than an inner diameter of the reduced-inner-diameter portion.

4. The ignition device for an internal combustion engine of claim 1, wherein a diameter of the larger diameter portion is larger than an inner diameter of the reduced-inner-diameter portion.

* * * * *